US011686551B2

(12) United States Patent
Kincel et al.

(10) Patent No.: US 11,686,551 B2
(45) **Date of Patent: *Jun. 27, 2023**

(54) FIREARM HANDGUARD ASSEMBLY

(71) Applicant: BRAVO COMPANY MFG, INC., Hartland, WI (US)

(72) Inventors: Eric Stephen Kincel, Coeur d'Alene, ID (US); Jeffrey James O'Brien, Coeur d'Alene, ID (US)

(73) Assignee: BRAVO COMPANY MFG, INC., Hartland, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/570,044

(22) Filed: Jan. 6, 2022

(65) Prior Publication Data

US 2022/0128331 A1 Apr. 28, 2022

Related U.S. Application Data

(63) Continuation of application No. 17/127,037, filed on Dec. 18, 2020, now Pat. No. 11,248,874, which is a (Continued)

(51) Int. Cl.

| | |
|---|---|
| ***F41C 23/16*** | (2006.01) |
| ***F41A 21/48*** | (2006.01) |
| ***F41A 5/18*** | (2006.01) |

(52) U.S. Cl.

CPC ..... *F41C 23/16* (2013.01); *F41A 5/18* (2013.01); *F41A 21/485* (2013.01)

(58) Field of Classification Search

CPC ..... F41C 23/16; F41A 11/00; F41A 11/02; F41A 3/66; F41A 5/18; F41A 21/482 (Continued)

(56) References Cited

U.S. PATENT DOCUMENTS

| | | | |
|---|---|---|---|
| 2,078,010 | A | 4/1937 | Meepos |
| 2,102,964 | A | 12/1937 | Mosseberg |

(Continued)

FOREIGN PATENT DOCUMENTS

| | | | |
|---|---|---|---|
| EP | 1832835 | A1 | 9/2007 |
| WO | 2013010515 | A1 | 1/2013 |

OTHER PUBLICATIONS

B5 SYSTEMS, "Keymod Hand Guard, Mid Length" <http://b5systems.com/keymod-hand-guard-mid-length/>, webpage publicly available at least as early as Dec. 20, 2016, 2 pages.

(Continued)

*Primary Examiner* — Joshua E Freeman

(74) *Attorney, Agent, or Firm* — Michael Best & Friedrich LLP

(57) ABSTRACT

A handguard assembly for installation on a firearm includes a handguard, an index block, a first fastener, and a second fastener. The handguard includes first and second clearance apertures and the index block includes first and second threaded apertures. The first and second fasteners extend through the respective first and second clearance apertures and threaded into the respective first and second threaded apertures. The first and second fasteners define respective first and second longitudinal axes that are non-parallel and non-collinear with each other. Tightening the first and second fasteners with respect to the index block secures the handguard to the index block and prevents movement of the handguard relative firearm.

9 Claims, 17 Drawing Sheets

Related U.S. Application Data continuation of application No. 16/415,398, filed on May 17, 2019, now Pat. No. 10,900,743, which is a continuation of application No. 16/178,937, filed on Nov. 2, 2018, now Pat. No. 10,295,304, which is a continuation-in-part of application No. 15/885,071, filed on Jan. 31, 2018, now Pat. No. 10,126,094, which is a continuation of application No. 15/701,982, filed on Sep. 12, 2017, now abandoned, which is a continuation of application No. 15/153,464, filed on May 12, 2016, now Pat. No. 9,791,239.

(58) Field of Classification Search
USPC ..... 42/71.01, 75.01, 75.02, 75.03
See application file for complete search history.

(56) References Cited

U.S. PATENT DOCUMENTS 2,685,754 A 8/1954 Crittendon et al.
3,066,375 A 12/1962 Knowles et al.
3,177,587 A 4/1965 Hart
3,512,653 A 5/1970 Erismann
3,559,940 A 2/1971 Kruzell
3,798,818 A 3/1974 Casull
3,844,627 A 10/1974 Gutner
3,861,070 A 1/1975 Wild et al.
4,167,884 A 9/1979 Santanna
4,663,875 A 5/1987 Tatro
4,905,396 A 3/1990 Bechtel
4,959,908 A 10/1990 Weyrauch
5,078,215 A 1/1992 Nau
5,412,895 A 5/1995 Krieger
5,590,484 A 1/1997 Mooney et al.
5,603,594 A 2/1997 Lincoln
5,632,108 A 5/1997 Ruger et al.
6,499,245 B1 12/2002 Swan
6,609,321 B2 8/2003 Faifer
6,671,990 B1 1/2004 Booth
6,836,990 B2 1/2005 Shiloni
6,874,269 B2 4/2005 Chen et al.
RE39,465 E 1/2007 Swan
7,216,451 B1 5/2007 Troy
7,325,352 B2 2/2008 Matthews et al.
7,430,829 B2 10/2008 Murello
7,458,179 B2 12/2008 Swan
7,464,495 B2 12/2008 Cahill
D613,811 S 4/2010 Swan
7,712,242 B2 5/2010 Matthews et al.
7,716,865 B2 5/2010 Daniel et al.
7,770,317 B1 8/2010 Tankersley
7,793,452 B1 9/2010 Samson et al.
D636,453 S 4/2011 Fitzpatrick et al.
D641,450 S 7/2011 Ding
7,971,384 B2 7/2011 Lippard
8,006,430 B2 8/2011 Wang
8,051,595 B2 11/2011 Hochstrate et al.
8,141,285 B2 3/2012 Brown
8,141,289 B2 3/2012 Gomez et al.
8,201,353 B1 6/2012 Swan
8,245,428 B2 8/2012 Griffin
8,251,051 B2 8/2012 Maggiore
8,276,303 B2 10/2012 Kapusta et al.
8,312,668 B2 11/2012 Kincel
8,438,770 B2 5/2013 Troy
8,448,367 B2 5/2013 Samson et al.
8,453,364 B2 6/2013 Kuczynko
8,490,316 B2 7/2013 Kincel et al.
8,539,708 B2 9/2013 Kenney et al.
8,578,647 B2 11/2013 Storch et al.
8,607,490 B1 12/2013 Zinsner
D703,286 S 4/2014 Chen et al.
8,739,448 B2 6/2014 Kimmel et al.
8,752,320 B2 6/2014 Masters
D709,582 S 7/2014 Geissele
8,782,943 B2 7/2014 Jarboe
D710,964 S 8/2014 Chvala
8,819,980 B2 9/2014 Geissele
D717,907 S 11/2014 Montes
D717,908 S 11/2014 Montes
D720,421 S 12/2014 Chen
8,904,691 B1 12/2014 Kincel
D721,407 S 1/2015 Chu
8,925,236 B1 1/2015 Mayberry et al.
D722,356 S 2/2015 Keller et al.
D725,723 S 3/2015 Eddie
D728,723 S 5/2015 Peterson et al.
D736,886 S 8/2015 Cheng et al.
D737,397 S 8/2015 Cheng et al.
9,103,625 B2 8/2015 Masters
9,140,506 B2 9/2015 Gomez
9,157,697 B2 10/2015 Leclair
D744,054 S 11/2015 Peterson et al.
D746,399 S 12/2015 Folkestad, II et al.
D746,936 S 1/2016 Huang
D747,426 S 1/2016 Cheng et al.
D747,428 S 1/2016 Chen
9,228,793 B2 1/2016 Samaras et al.
9,239,209 B2 1/2016 Mayberry et al.
9,239,210 B2 1/2016 Mayberry et al.
D749,181 S 2/2016 Hu
D751,663 S 3/2016 Ding et al.
D752,171 S 3/2016 Chen
9,297,599 B2 3/2016 Underwood et al.
9,303,949 B1 * 4/2016 Oglesby ..... F41C 23/16
9,322,609 B2 4/2016 Davies
D755,338 S 5/2016 Slank
D757,201 S 5/2016 Meier
D757,204 S 5/2016 Chow et al.
D757,878 S 5/2016 Barfoot et al.
9,377,274 B2 6/2016 Kincel
9,383,163 B2 7/2016 Kincel et al.
9,389,043 B1 7/2016 Zhang
D764,620 S 8/2016 Packard et al.
9,423,194 B2 8/2016 Fritz et al.
9,429,388 B2 8/2016 Mayberry et al.
D768,800 S 10/2016 Willits
9,459,078 B1 10/2016 Kincel
9,464,865 B2 10/2016 Shea et al.
9,470,472 B2 10/2016 Kincel et al.
9,476,672 B2 10/2016 Wells et al.
D770,590 S 11/2016 Sui
D771,216 S 11/2016 Dubois
D774,616 S 12/2016 Barrett
9,513,083 B1 * 12/2016 Oglesby ..... F41C 23/16
9,523,554 B2 12/2016 Mayberry et al.
9,528,793 B1 * 12/2016 Oglesby ..... F41C 23/00
D779,013 S 2/2017 Cheng et al.
D779,014 S 2/2017 Cheng et al.
9,581,412 B2 2/2017 Cheng et al.
9,599,439 B1 3/2017 Sylvester
D783,760 S 4/2017 Pavlick
D783,761 S 4/2017 Pavlick
9,625,233 B2 4/2017 Daniel et al.
D785,743 S 5/2017 Pavlick
9,696,112 B2 7/2017 Gottzmann et al.
9,709,358 B2 7/2017 Kincel
D795,986 S 8/2017 Frederickson et al.
9,766,035 B2 9/2017 Storch
9,772,161 B1 9/2017 Cheng
9,791,239 B1 10/2017 Kincel et al.
9,921,029 B2 3/2018 Roberts et al.
D815,710 S 4/2018 Packard et al.
D818,073 S 5/2018 Dubois
9,964,380 B1 5/2018 Oglesby
9,995,557 B2 6/2018 Geissele
D827,082 S 8/2018 Dubois
D828,480 S 9/2018 Hiler, Jr. et al.
D828,898 S 9/2018 McKillips
D834,113 S 11/2018 Chu
10,126,094 B2 11/2018 Kincel et al.
10,126,095 B1 11/2018 Reid
10,145,648 B1 12/2018 Holder et al.
D844,091 S 3/2019 Kincel et al.

(56) References Cited

U.S. PATENT DOCUMENTS

| | | | |
|---|---|---|---|
| 10,240,901 | B1 | 3/2019 | Cheng |
| 10,260,838 | B1 | 4/2019 | Kincel et al. |
| 10,260,841 | B2 | 4/2019 | Kincel et al. |
| 10,274,283 | B1 | 4/2019 | Oglesby |
| 10,295,304 | B1 | 5/2019 | Kincel et al. |
| D851,200 | S | 6/2019 | Ding et al. |
| 10,309,747 | B2 | 6/2019 | Samson et al. |
| 10,345,075 | B1 | 7/2019 | Oglesby |
| 10,401,122 | B2 | 9/2019 | Williams |
| D865,111 | S | 10/2019 | Storch |
| 10,473,432 | B2 | 11/2019 | Jen |
| D872,218 | S | 1/2020 | Kincel et al. |
| D879,904 | S | 3/2020 | Kincel et al. |
| 10,619,971 | B2 | 4/2020 | Hubbell et al. |
| D888,184 | S | 6/2020 | Bietsch et al. |
| D891,563 | S | 7/2020 | Hu |
| D903,806 | S | 12/2020 | Storch |
| D904,545 | S | 12/2020 | Chin |
| 10,883,794 | B2 | 1/2021 | Jen et al. |
| 2001/0045046 | A1 | 11/2001 | Otteman |
| 2003/0230022 | A1 | 12/2003 | Battaglia |
| 2004/0009034 | A1 | 1/2004 | Miller |
| 2004/0049964 | A1 | 3/2004 | Vais |
| 2005/0268512 | A1 | 12/2005 | Battaglia |
| 2006/0065112 | A1 | 3/2006 | Kuczynko et al. |
| 2006/0191183 | A1 | 8/2006 | Griffin |
| 2007/0017139 | A1 | 1/2007 | Larue |
| 2008/0092422 | A1 | 4/2008 | Daniel et al. |
| 2008/0301994 | A1 | 12/2008 | Langevin et al. |
| 2009/0000175 | A1 | 1/2009 | Potterfield et al. |
| 2009/0100734 | A1 | 4/2009 | Swan et al. |
| 2009/0178325 | A1 | 7/2009 | Veilleux |
| 2010/0095575 | A1 | 4/2010 | Swan |
| 2010/0122485 | A1 | 5/2010 | Kincel |
| 2010/0242332 | A1 | 9/2010 | Teetzel et al. |
| 2010/0319231 | A1 | 12/2010 | Stone et al. |
| 2011/0032694 | A1 | 2/2011 | Swan et al. |
| 2011/0126443 | A1 | 6/2011 | Sirois |
| 2011/0192066 | A1 | 8/2011 | Kimmel et al. |
| 2011/0247254 | A1 | 10/2011 | Barnes |
| 2012/0042557 | A1 | 2/2012 | Gomez et al. |
| 2012/0097807 | A1 | 4/2012 | Rees |
| 2012/0124880 | A1 | 5/2012 | Leclair |
| 2012/0016743 | A1 | 7/2012 | Masters |
| 2012/0167434 | A1 | 7/2012 | Masters |
| 2012/0180359 | A1 | 7/2012 | Fitzpatrick et al. |
| 2012/0186123 | A1 | 7/2012 | Troy et al. |
| 2012/0311908 | A1 | 12/2012 | Kenney et al. |
| 2012/0324775 | A1 | 12/2012 | Troy et al. |
| 2013/0031820 | A1 | 2/2013 | Deras |
| 2013/0036646 | A1 | 2/2013 | Rubac et al. |
| 2013/0104441 | A1 | 5/2013 | Kincel |
| 2013/0133238 | A1 | 5/2013 | Quetschke |
| 2013/0180151 | A1 | 7/2013 | Moore |
| 2013/0276341 | A1 | 10/2013 | Wells et al. |
| 2013/0318848 | A1 | 12/2013 | Kincel |
| 2013/0318852 | A1 | 12/2013 | Teetzel et al. |
| 2014/0000142 | A1 | 1/2014 | Patel |
| 2014/0026459 | A1 | 1/2014 | Yan et al. |
| 2014/0041273 | A1 | 2/2014 | Masters |
| 2014/0075817 | A1 | 3/2014 | Gomez |
| 2014/0082990 | A1 | 3/2014 | Lee |
| 2014/0115938 | A1 | 5/2014 | Jarboe |
| 2014/0115939 | A1 | 5/2014 | Troy et al. |
| 2014/0115940 | A1 | 5/2014 | Bonelli et al. |
| 2014/0130390 | A1 | 5/2014 | Geissele |
| 2014/0204566 | A1 | 7/2014 | Kay |
| 2014/0373419 | A1 | 12/2014 | Leclair |
| 2015/0000171 | A1 | 1/2015 | Roberts |
| 2015/0198408 | A1 | 7/2015 | Kincel et al. |
| 2015/0219422 | A1 | 8/2015 | Kincel |
| 2015/0267993 | A1 | 9/2015 | Cheng et al. |
| 2015/0285583 | A1 | 10/2015 | Mayberry et al. |
| 2015/0285584 | A1 | 10/2015 | Mayberry et al. |
| 2015/0285585 | A1 | 10/2015 | Hewes et al. |
| 2015/0316347 | A1 | 11/2015 | Shea et al. |
| 2015/0369555 | A1 | 12/2015 | Daniel et al. |
| 2015/0369558 | A1 | 12/2015 | Gottzmann |
| 2016/0010946 | A1 | 1/2016 | Gibbons et al. |
| 2016/0025120 | A1 | 1/2016 | Swan et al. |
| 2016/0054096 | A1 | 2/2016 | Dzwill |
| 2016/0091277 | A1 | 3/2016 | Mayberry et al. |
| 2016/0169617 | A1 | 6/2016 | Daley, Jr. |
| 2016/0187100 | A1 | 6/2016 | Mayberry et al. |
| 2016/0195350 | A1 | 7/2016 | Packard et al. |
| 2016/0349011 | A1 | 12/2016 | Jen |
| 2017/0016695 | A1 | 1/2017 | Willits |
| 2017/0067718 | A1 | 3/2017 | Mayberry et al. |
| 2017/0097207 | A1 | 4/2017 | Hines |
| 2017/0205183 | A1 | 7/2017 | Ding et al. |
| 2017/0261276 | A1 | 9/2017 | Morris |
| 2017/0307328 | A1 | 10/2017 | Shelton et al. |
| 2018/0023919 | A1 | 1/2018 | Kincel et al. |
| 2019/0226799 | A1 | 7/2019 | Hubbell et al. |

OTHER PUBLICATIONS

Recoil, "B5 Systems Color Wheels," <http://www.recoilweb.com/b5-systems-color-wheels-39707.html>, webpage publicly available at least as early as Dec. 20, 2016, 4 pages.

Evike, <http://www.evike.com/images/large/HG_MP _PTSMOE2.jpg>, webpage publicly available at least as early as Dec. 20, 2016, 1 page.

Evike, "Matrix Triple Rail Set w/ Screws for PTS/MOE/MASADA/ACR Handguards—Black" <http://www.evike.com/products/30805/>, webpage publicly available at least as early as Dec. 20, 2016, 4 pages.

Bravo Company USA, "BCMGUNFIGHTER PKMR Mid Length—Black,"<https://www.bravocompanyusa.com/BCM-PKMR-POLYMER-KEYMOD-RAIL-p/bcm-pkmr-mid-blk.htm>, website visited Oct. 17, 2017, 5 pages.

Bravo Company USA, "BCMGUNFIGHTER PKMR Carbine Length—Black," <https://www.bravocompanyusa.com/BCM-PKMR-POLYMER-KEYMOD-RAIL-Carbine-p/bcm-pkmr-car-blk.htm>, website visited Oct. 17, 2017, 5 pages.

RECOILweb, "RECOILtv Mail Call: Some Fall 2016 New BCM Products (full episode)," <https://www.youtube.com/watch?v=_FKkwuh4kCg>, published on Sep. 26, 2016, website visited Oct. 17, 2017, 2 pages.

Academy Sports + Outdoors, "Magpul MOE M-LOK AR-15/M4 Mid-Length Hand Guard," <http://www.academy.com/shop/pdp/magpul-moe-m-lok-ar-15m4-mid-length-hand-guard>, website visited Oct. 17, 2017, 2 pages.

Magpul, "The M-LOK System," <www.magpul.com/foundations>, brochure (2014) 10 pages.

Magpul, "The M-LOK System," <www.magpul.com/foundations>, brochure (2014) Rev. 1.2, 10 pages.

* cited by examiner

FIREARM HANDGUARD ASSEMBLY

CROSS-REFERENCE TO RELATED APPLICATIONS

This application is a continuation of U.S. application Ser. No. 17/127,037 filed Dec. 18, 2020, now U.S. Pat. No. 11,248,874, which is a continuation of U.S. application Ser. No. 16/415,398 filed May 17, 2019, now U.S. Pat. No. 10,900,743, which is a continuation of U.S. application Ser. No. 16/178,937 filed Nov. 2, 2018, now U.S. Pat. No. 10,295,304, which is a continuation-in-part of U.S. application Ser. No. 15/885,071 filed Jan. 31, 2018, now U.S. Pat. No. 10,126,094, which is a continuation of U.S. application Ser. No. 15/701,982 filed Sep. 12, 2017, abandoned, which is a continuation of U.S. application Ser. No. 15/153,464 filed May 12, 2016, now U.S. Pat. No. 9,791,239.

TECHNICAL FIELD

The present invention generally concerns firearm equipment. More particularly, the present invention relates to a firearm handguard assembly.

BACKGROUND

Traditionally, a handguard is mounted to a firearm using an assembly that uses a basic clamp on the handguard (which may or may not be integrated with the handguard itself) with a slice-bottom design, wherein the bottom portion of the clamp is held together with screws, a two-sided slice design, or a multi-part clamp design. When the screws are tightened, the clamp bears down on the handguard, holding the handguard to the barrel nut. The barrel nut holds the barrel of the firearm in place and is attached to the upper receiver. However, this design is problematic. The tension created by the clamp holds the handguard in place on the barrel nut, but places stress on the upper area of the handguard, which is weaker due to design constraints. This area expands as the clamping mechanism is tightened and more so when the firearm is in use due to the heat generated between the barrel of the firearm, which causes the stress imparted by the clamp to relax as the parts expand due to heat. Traditional designs have placed their hardware in a disadvantaged location due to the lack of clearance available between the various components on top of the barrel nut. There is, therefore, a need for an improved firearm handguard assembly system that obviates the shortcomings of the traditional clamping design.

Similarly, even when a handguard is properly mounted to a firearm, the movement of the handguard may loosen the barrel nut and could result in damage to the firearm. Several solutions have been offered to index the handguard to the upper receiver of the firearm. The most common solution is an anti-slip plate that is affixed to the barrel nut using several screws. This type of assembly can be complicated and time-consuming for the user. Yet another design is a handguard with an indexing tab (or "finger") that extends from the handguard and indexes to the upper receiver of the firearm. Therefore, there is a need for an indexing system that is simple and user-friendly.

The present invention is aimed at one or more of the problems identified above.

SUMMARY

In one aspect the invention provides a handguard assembly for installation on a firearm, the assembly comprising: a handguard including first and second clearance apertures; an index block having a first and second threaded apertures; a first fastener extending through the first clearance aperture and threaded into the first threaded aperture to tighten the first fastener with respect to the index block, the first fastener defining a first longitudinal axis; and a second fastener extending through the second clearance aperture and threaded into the second threaded aperture to tighten the second fastener with respect to the index block, the second fastener defining a second longitudinal axis that is non-parallel and non-collinear with the first longitudinal axis; wherein tightening the first and second fasteners with respect to the index block secures the handguard to the index block and prevents movement of the handguard relative firearm.

In some embodiments, wherein the second longitudinal axis is coplanar with the first longitudinal axis. In some embodiments, an angle between the first longitudinal axis and the second longitudinal axis is approximately 90 degrees. In some embodiments, the first and second threaded apertures are blind bores in the index block. In some embodiments, the firearm includes a gas tube and the index block extends at least partially over the gas tube. In some embodiments, the firearm includes a barrel nut defining an outer surface having a groove, a portion of the index block extending into the groove to resist movement of the handguard assembly in at least one direction with respect to the firearm. In some embodiments, the firearm includes a barrel nut defining an outer circular surface and the first and second longitudinal axes are parallel to respective first and second tangents to the circular surface. In some embodiments, the first and second fasteners are both above a horizontal plane bisecting the barrel nut. In some embodiments, the first and second fasteners are positioned symmetrically about a vertical plane.

In another aspect, the invention provides a firearm comprising: an upper receiver; a barrel; a barrel nut securing the barrel to the upper receiver; an index block in direct contact with a first portion of the barrel nut and including first and second threaded apertures; a handguard extending at least partially around the barrel nut and in direct contact with a second portion of the barrel nut, the handguard including first and second clearance apertures; a first fastener extending through the first clearance aperture and threaded into the first threaded aperture to tighten the first fastener with respect to the index block, the first fastener defining a first longitudinal axis; and a second fastener extending through the second clearance aperture and threaded into the second threaded aperture to tighten the second fastener with respect to the index block, the second fastener defining a second longitudinal axis that is non-parallel and non-collinear with the first longitudinal axis; wherein tightening the first and second fasteners with respect to the index block secures the handguard against the second portion of the barrel nut.

In some embodiments, the second longitudinal axis is coplanar with the first longitudinal axis. In some embodiments, an angle between the first longitudinal axis and the second longitudinal axis is approximately 90 degrees. In some embodiments, the first and second threaded apertures are blind bores in the index block. In some embodiments, the invention further comprises a gas tube communicating between the barrel and the upper receiver, wherein the index block extends over at least partially over the gas tube. In some embodiments, the barrel nut defines an outer surface having a groove and a portion of the index block extends into the groove to resist movement of the handguard assembly in at least one direction with respect to the barrel nut. In some embodiments, the barrel nut defines an outer circular surface and the first and second longitudinal axes are parallel to respective first and second tangents to the circular surface. In some embodiments, the first and second fasteners are both above a horizontal plane bisecting the barrel nut. In some embodiments, the first and second fasteners are positioned symmetrically about a vertical plane.

BRIEF DESCRIPTION OF THE DRAWINGS

Other advantages of the present invention will be readily appreciated as the same becomes better understood by reference to the following detailed description when considered in connection with the accompanying drawings wherein.

Corresponding reference characters indicate corresponding parts throughout the drawings.

DETAILED DESCRIPTION

Embodiments of the present invention provide a handguard assembly and system and method of mounting the assembly to a firearm. Persons of ordinary skill in the art will realize that the following description of the presently invention is illustrative only and not in any way limiting. Other embodiments of the invention will readily suggest themselves to such skilled persons.

Other improved designs have included the use of clamp blocks, cross bolts, and an indexing plate, as described in U.S. Pat. No. 8,904,691, issued to Eric S. Kincel, which is incorporated herein by reference. The design of the present invention uses screws and an index clamp rather than cross bolts and a plurality of clamp blocks.

Figure 1A:
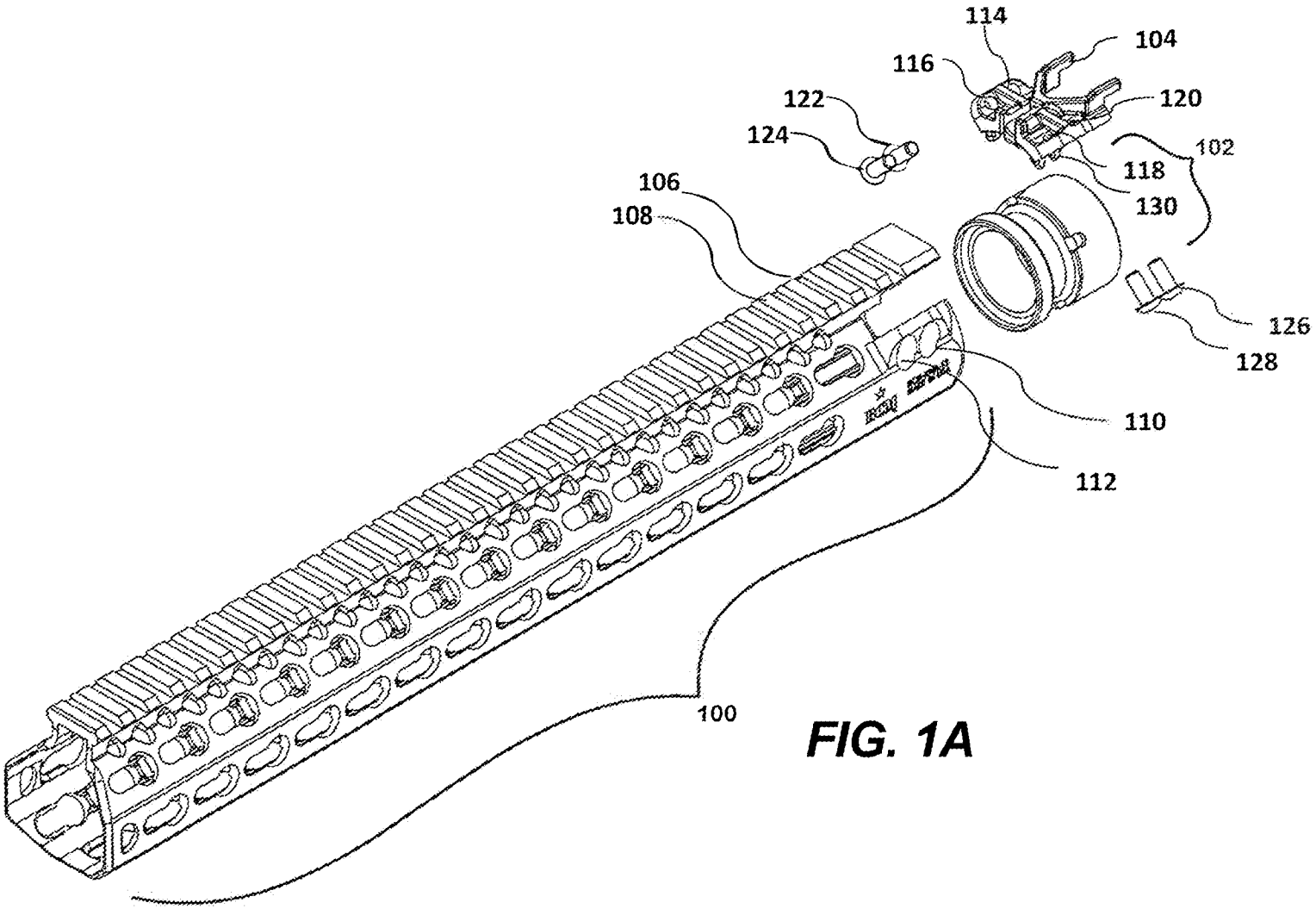
FIG. 1A illustrates an exploded view of an exemplary handguard assembly according to a first embodiment.

Referring now to FIG. 1A, illustrating an exploded view of a firearm handguard assembly system according to a first embodiment, a handguard 100 is coupled to a threaded end of barrel nut 102 to mount the upper receiver of a firearm (FIG. 1I) to handguard 100.

It is contemplated that any handguard may be used in connection with the present invention. In a preferred embodiment, the handguard is made from magnesium rather than aluminum, the typical material for handguards in the industry. Magnesium is lighter than aluminum by a ratio of 1:3, and is therefore an ideal structural material for handguards because it reduces strain on the firearm user during use. However, handguards made from any suitable structural material may be used in connection with the present invention, including without limitation steel (carbon and stainless), aluminum, and titanium.

It is also contemplated that the handguard may contain KeyMod holes, a picatinny rail (also known as a MIL-STD-1913 accessory rail), Magpul® M-LOK® System, GIBBZ Arms™ Modular Attachment (GAMA) System, and/or any other interface system currently available or later developed.

According to the first embodiment, the threaded end of barrel nut 102 is placed inside a first end of handguard 100. Without an index block or plate, the movement of the handguard may loosen the barrel nut and could result in damage to the firearm. Use of index block 104 eliminates rotation of handguard 100 during use.

A first end of handguard 100 contains a first aperture 106 and a second aperture 108 on a first side, and a third aperture 110 and a fourth aperture 112 on a second side. Index block 104 contains a first aperture 114 and a second aperture 116 on a first side, and a third aperture 118 and a fourth aperture 120 on a second side. Index block 104 is placed inside the first end of handguard 100 such that first aperture 114 of index block 104 is aligned with first aperture 106 of handguard 100 and second aperture 116 of index block 104 is aligned with second aperture 108 of handguard 100. On the second side of index block 104, third aperture 118 of index block 104 is aligned with third aperture 110 of handguard 100 and fourth aperture 120 of index block 104 is aligned with fourth aperture 112 of handguard 100.

A first screw 122 is threaded through first aperture 106 of handguard 100 and first aperture 114 of index block 104. A second screw 124 is threaded through second aperture 108 of handguard 100 and second aperture 116 of index block 104. A third screw 126 is threaded through third aperture 110 of handguard 100 and third aperture 118 of index block 104. A fourth screw 128 is threaded through fourth aperture 112 of handguard 100 and fourth aperture 120 of index block 104.

Index block 104 further includes feet, one of which is labeled 130, which interface with barrel nut 102.

During threading as described above, screws 122, 124, 126, and 128 preclude longitudinal movement of handguard 100, while clamping down on the body of handguard 100 to cause residual force between barrel nut 102 and handguard 100. On an AR-15 platform, the mounting force is spread around the firearm's gas tube 138 (see FIG. 1H). The residual mounting force prevents the handguard from flexing or growing, which ultimately prevents rotation and slippage during use.

Figure 1B:
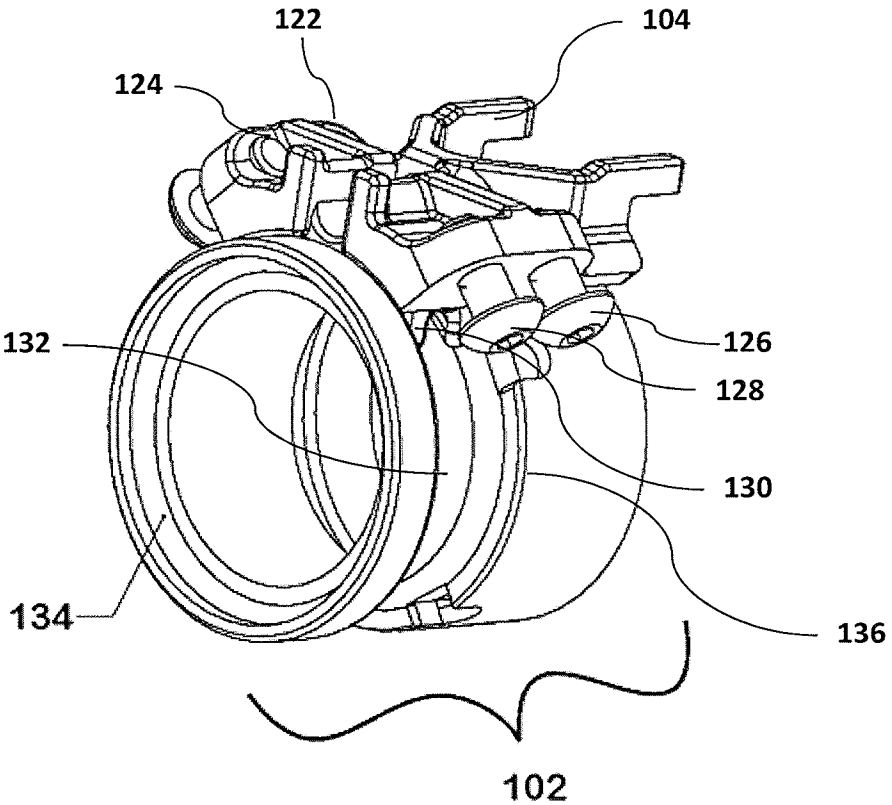
FIG. 1B illustrates a side perspective view of an index block of an exemplary handguard assembly according to a first embodiment.

Referring now to FIG. 1B, a side perspective view of index block 104 and barrel nut 102 of an exemplary handguard assembly according to the first embodiment is shown. Screws 122, 124, 126, and 128 are threaded through index block 104. Feet 130 of index block 104 interface with barrel nut 102 in a groove 132 between a first lip 134 of the threaded end barrel nut 102 and a second lip 136 of the smooth end of barrel nut 102.

Figure 1D:
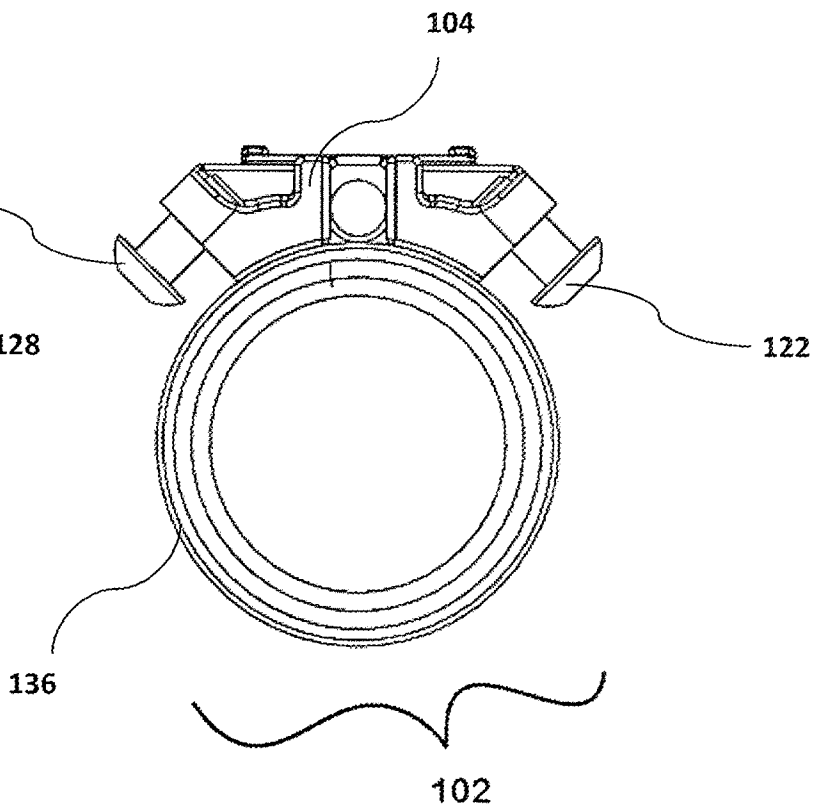
FIG. 1D illustrates a back view of an index block and a barrel nut of an exemplary handguard assembly according to a first embodiment.
Figure 1C:
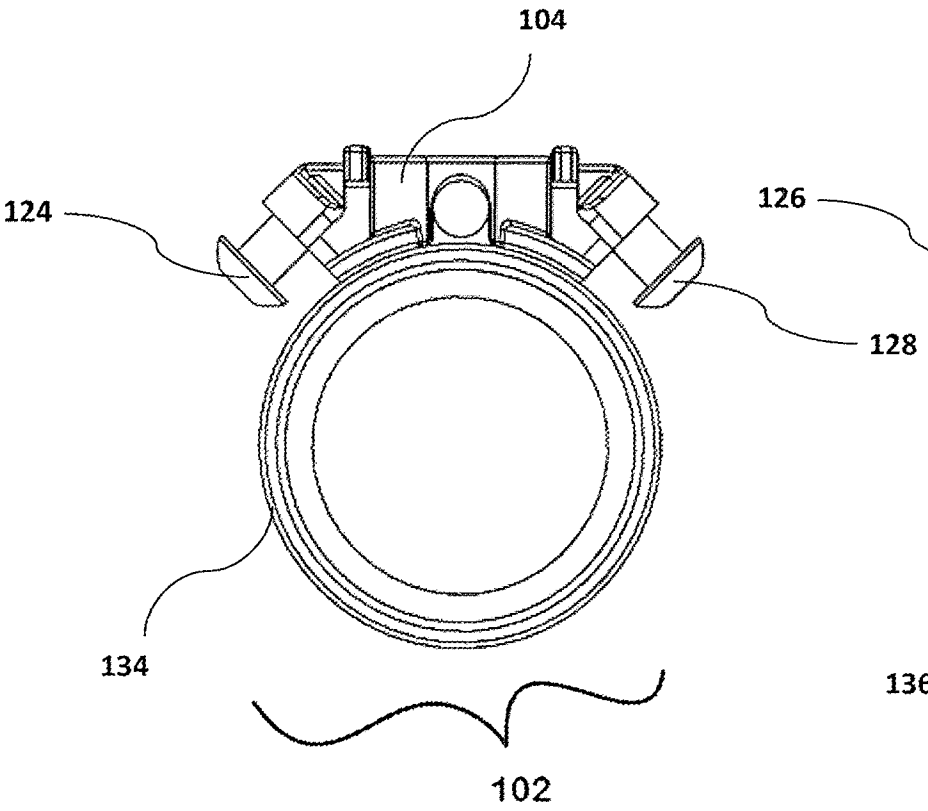
FIG. 1C illustrates a front view of an index block and a barrel nut of an exemplary handguard assembly according to a first embodiment.

Referring now to FIGS. 1C and 1D, a front view and a back view of index block 104 and barrel nut 102 of an exemplary handguard assembly according to the first embodiment are shown, respectively.

Figure 1F:
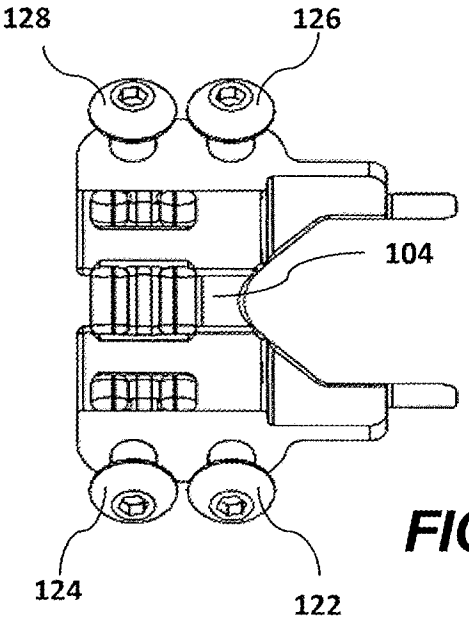
FIG. 1F illustrates a bottom view of an index block of an exemplary handguard assembly according to a first embodiment.
Figure 1E:
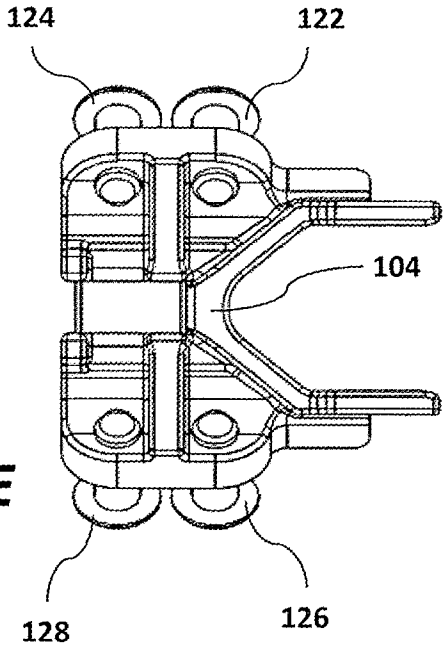
FIG. 1E illustrates a top view of an index block of an exemplary handguard assembly according to a first embodiment.

Referring now to FIGS. 1E and 1F, a top view and a bottom view of index block 104 of an exemplary handguard assembly according to the first embodiment are shown, respectively.

Figure 1G:
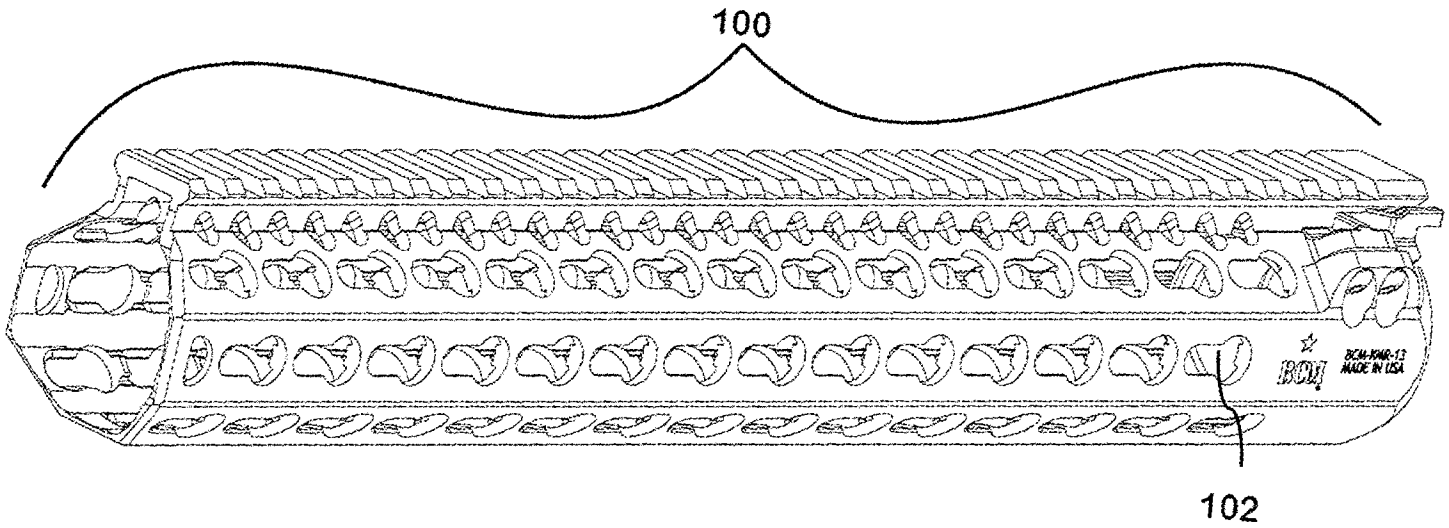
FIG. 1G illustrates a perspective view of a fully assembled exemplary handguard assembly system according to a first embodiment.
Figure 1H:
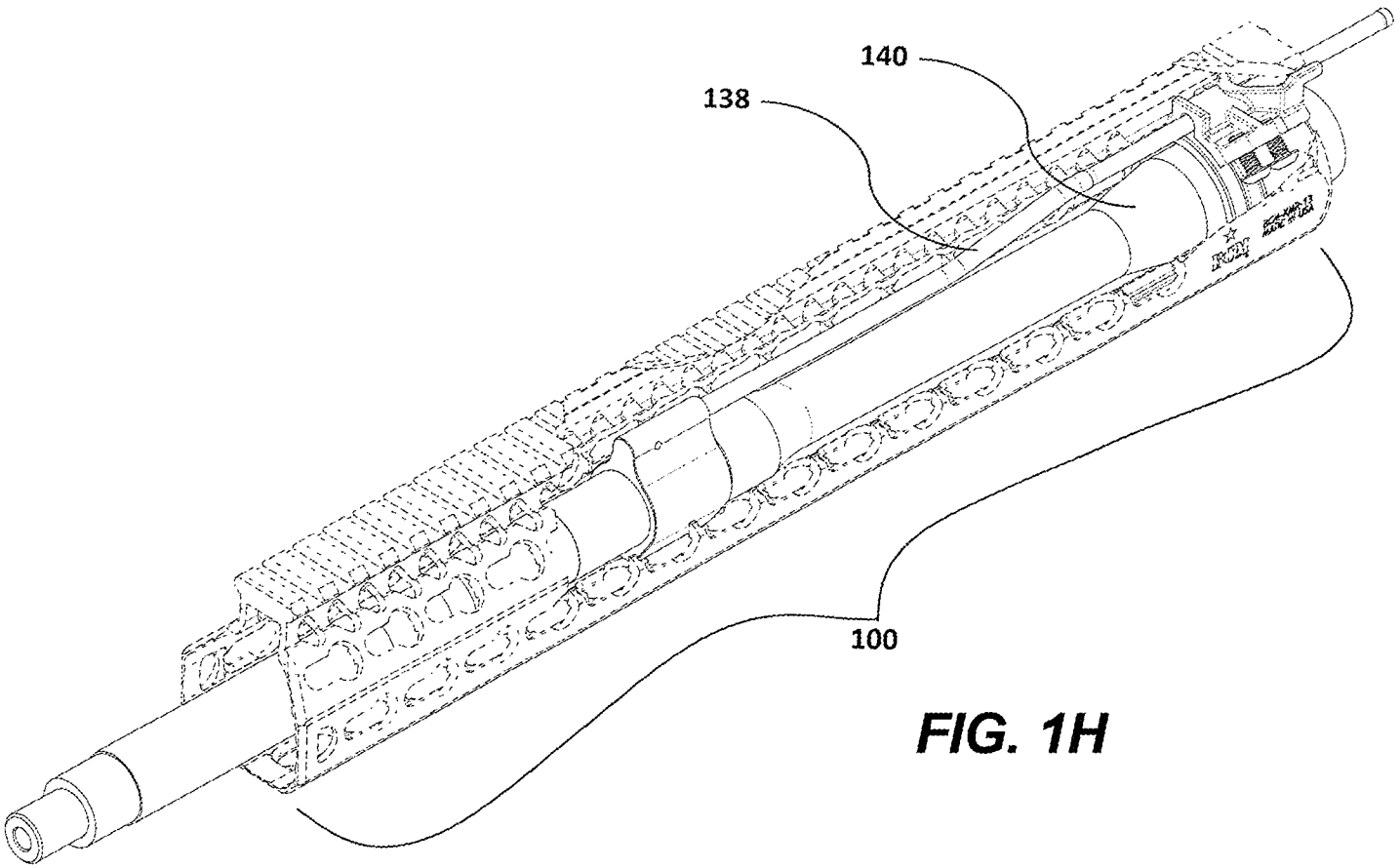
FIG. 1H illustrates a cross-sectional view of a of a fully assembled exemplary handguard assembly system according to a first embodiment.
Figure 1I:
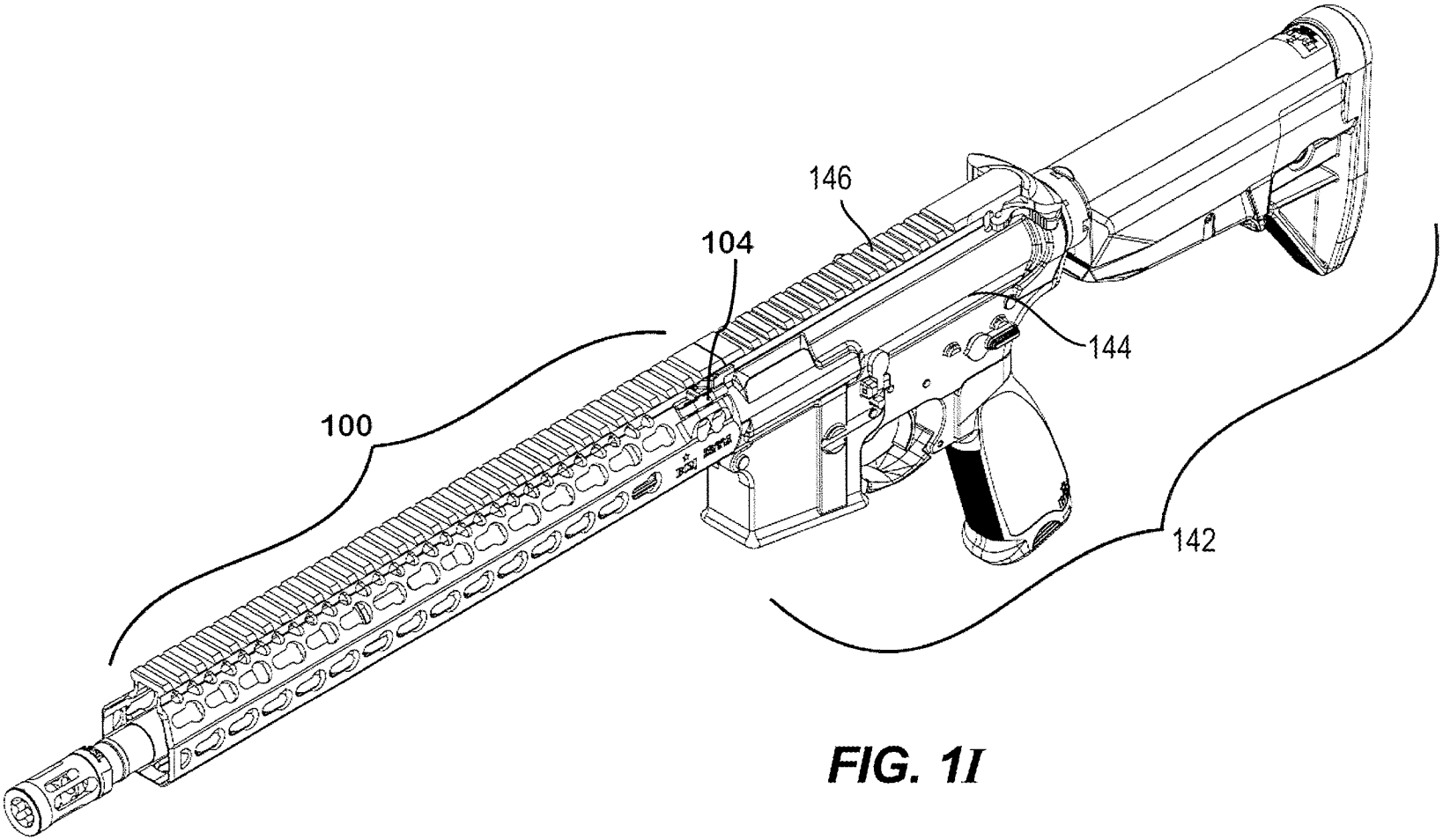
FIG. 1I illustrates a fully assembled firearm handguard assembly system on an exemplary firearm according to a first embodiment.

Referring now to FIG. 1G, illustrating a fully assembled firearm handguard assembly system according to the first embodiment, the barrel nut 102 is secured inside handguard 100 with screws 122, 124, 126, and 128, and with index block 104 in place, allowing handguard 100 to be fully indexed to the upper receiver of the firearm (FIG. 1I). The design of the firearm handguard assembly strengthens the grip of the handguard on the barrel nut, by eliminating non-continuous features within the clamping area of the handguard body, keeping the handguard tensioned in place even under high stress and heat when the firearm is in use.

Referring now to FIG. 1H, illustrating a cross-sectional view of a fully assembled exemplary handguard assembly system according to the first embodiment, the handguard 100 includes gas tube 138 and barrel 140.

Referring now to FIG. 1I, illustrating a fully assembled firearm handguard on an exemplary firearm 142 according to the first embodiment. The firearm 142 includes an upper receiver 144 having a receiver rail 146 to which accessories can be mounted. The illustrated receiver rail 146 is in the form of a Picatinny rail but could be provided in different forms known in the art. The handguard 100 is secured to exemplary firearm 142 at its upper receiver 144 with index block 104 and screws 122, 124, 126, and 128 in place.

Figure 2A:
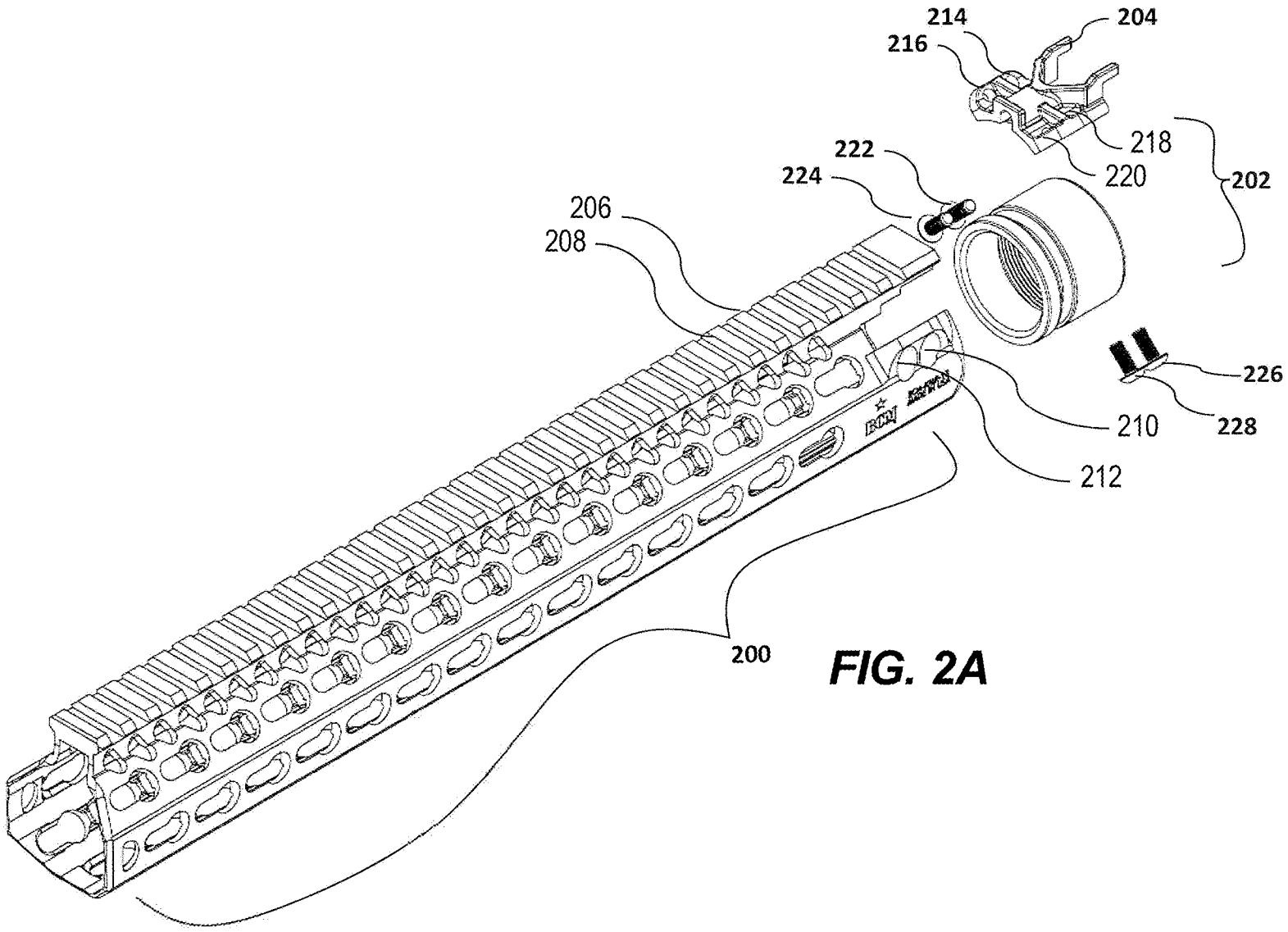
FIG. 2A illustrates an exploded view of an exemplary handguard assembly according to a second embodiment.

Referring now to FIG. 2A, illustrating an exploded view of a firearm handguard assembly system according to a second embodiment, a handguard 200 is coupled to a threaded end of barrel nut 202 to mount the upper receiver of a firearm (FIG. 2I) to handguard 200.

The threaded end of barrel nut 202 is placed inside a first end of handguard 200. Without an index block or plate, the movement of the handguard may loosen the barrel nut and could result in damage to the firearm. Use of index block 204 eliminates rotation of handguard 100 during use.

A first end of handguard 200 contains a first aperture 206 and a second aperture 208 on a first side, and a third aperture 210 and a fourth aperture 212 on a second side. Index block 204 contains a first aperture 214 and a second aperture 216 on a first side, and a third aperture 218 and a fourth aperture 220 on a second side. Index block 204 is placed inside the first end of handguard 200 such that first aperture 214 of index block 204 is aligned with first aperture 206 of handguard 200 and second aperture 216 of index block 204 is aligned with second aperture 208 of handguard 200. On the second side of index block 204, third aperture 218 of index block 204 is aligned with third aperture 210 of handguard 200 and fourth aperture 220 of index block 204 is aligned with fourth aperture 212 of handguard 200.

A first screw 222 is threaded through first aperture 206 of handguard 200 and first aperture 214 of index block 204. A second screw 224 is threaded through second aperture 208 of handguard 200 and second aperture 216 of index block 204. A third screw 226 is threaded through third aperture 210 of handguard 200 and third aperture 218 of index block 204. A fourth screw 228 is threaded through fourth aperture 212 of handguard 200 and fourth aperture 220 of index block 204.

During threading as described above, screws 222, 224, 226, and 228 preclude longitudinal movement of handguard 200, while clamping down on the body of handguard 200 to cause residual force between barrel nut 202 and handguard 200. On an AR-10 platform, the mounting force is spread under the gas tube 238 (see FIG. 2H). The residual mounting force prevents the handguard from flexing or growing, which ultimately prevents rotation and slippage during use.

Figure 2B:
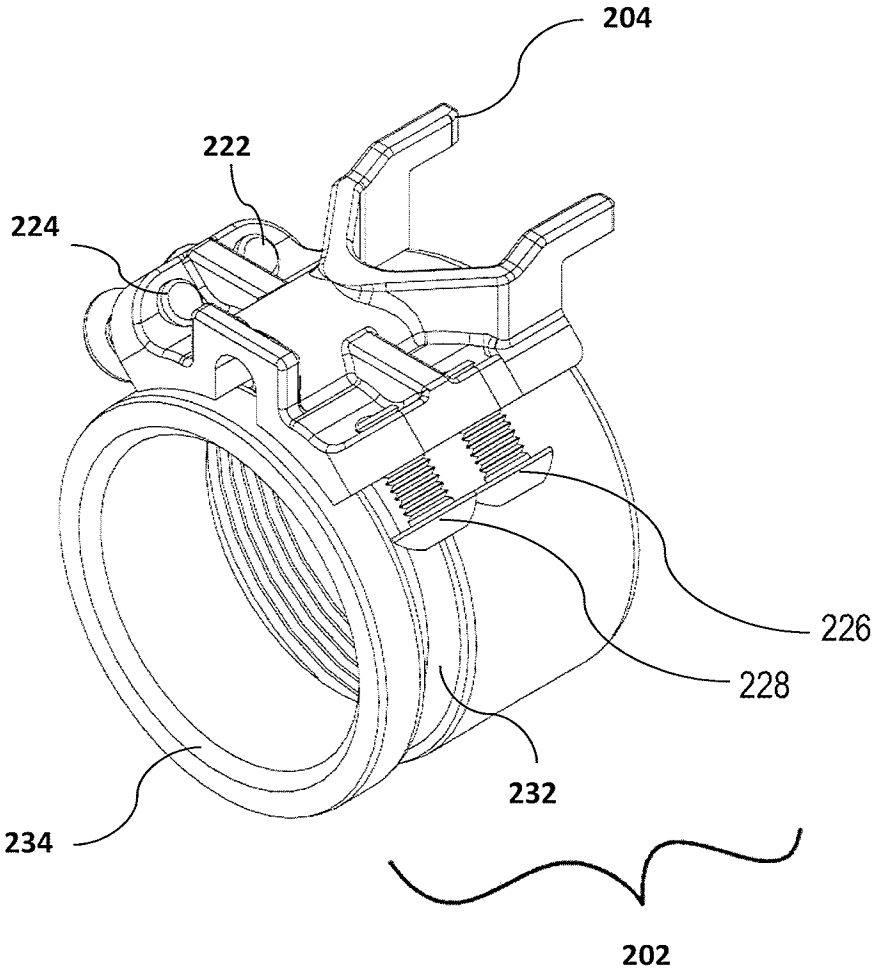
FIG. 2B illustrates a side perspective view of an index block of an exemplary handguard assembly according to a second embodiment.

Referring now to FIG. 2B, a side perspective view of index block 204 and barrel nut 202 of an exemplary handguard assembly according to the second embodiment is shown. Screws 222, 224, 226, and 228 are threaded through index block 204. Index block 204 interfaces with barrel nut 202 in a groove 232 between a first lip 234 of the threaded end barrel nut 202 and a second lip 236 of the smooth end of barrel nut 202.

Figure 2D:
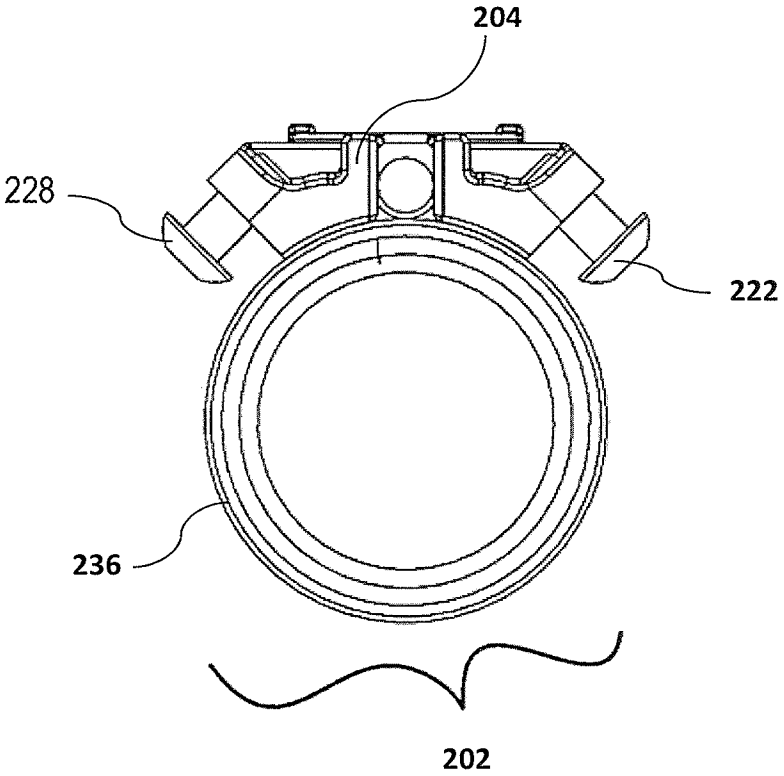
FIG. 2D illustrates a back view of an index block and a barrel nut of an exemplary handguard assembly according to a second embodiment.
Figure 2C:
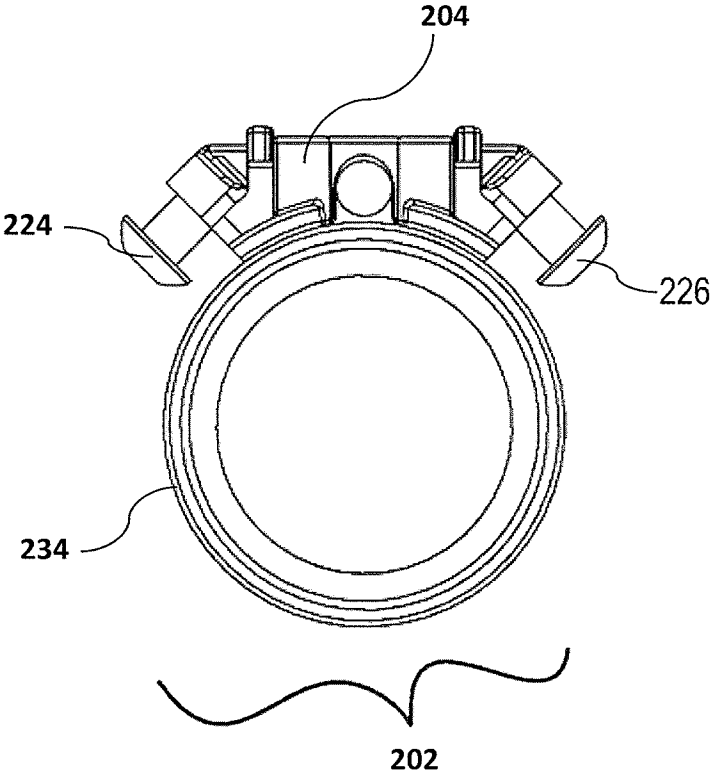
FIG. 2C illustrates a front view of an index block and a barrel nut of an exemplary handguard assembly according to a second embodiment.

Referring now to FIGS. 2C and 2D, a front view and a back view of index block 204 and barrel nut 202 of an exemplary handguard assembly according to the second embodiment are shown, respectively.

Figure 2F:
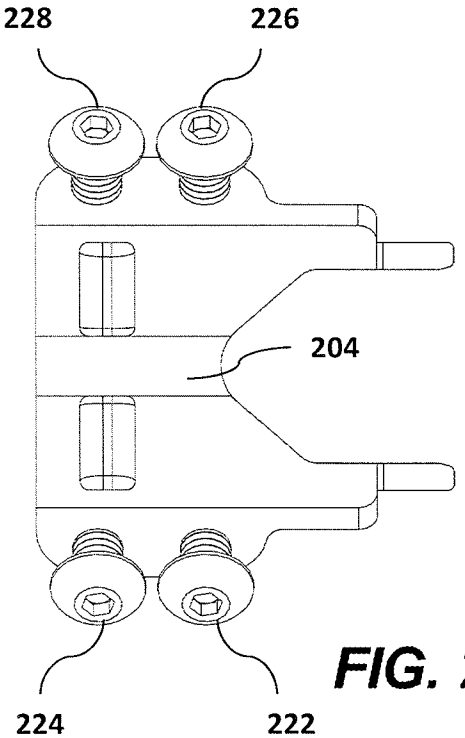
FIG. 2F illustrates a bottom view of an index block of an exemplary handguard assembly according to a second embodiment.
Figure 2E:
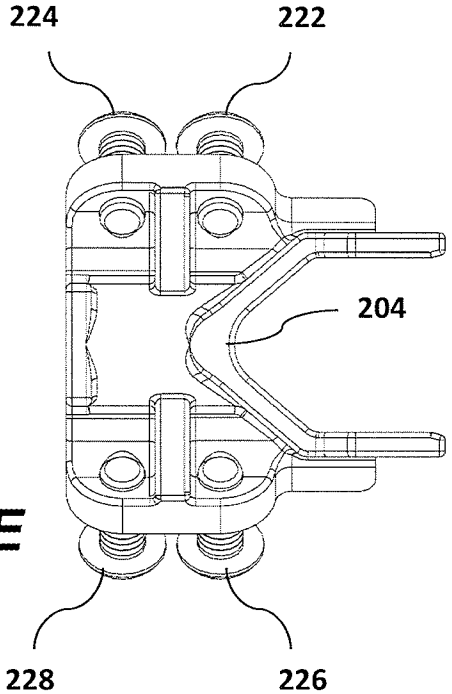
FIG. 2E illustrates a top view of an index block of an exemplary handguard assembly according to a second embodiment.

Referring now to FIGS. 2E and 2F, a top view and a bottom view of index block 204 of an exemplary handguard assembly according to the second embodiment are shown, respectively.

Figure 2G:
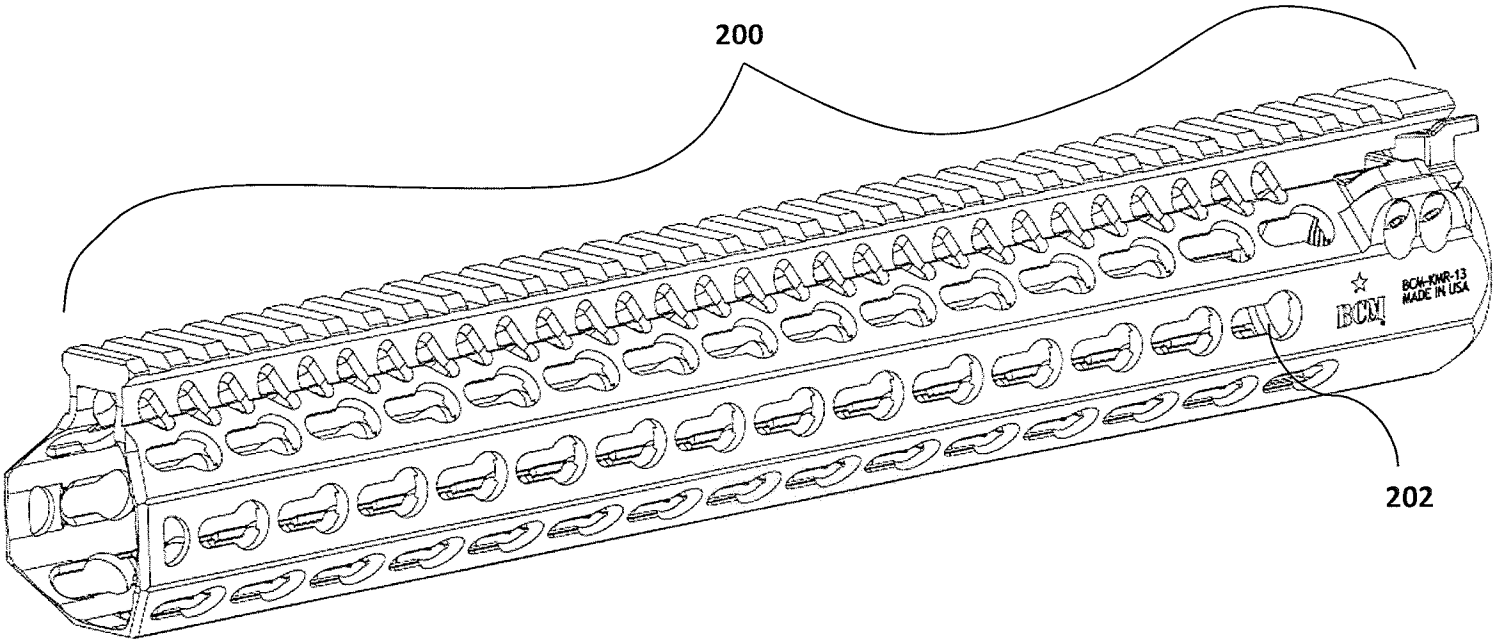
FIG. 2G illustrates a perspective view of a fully assembled exemplary handguard assembly system according to a second embodiment.
Figure 2H:
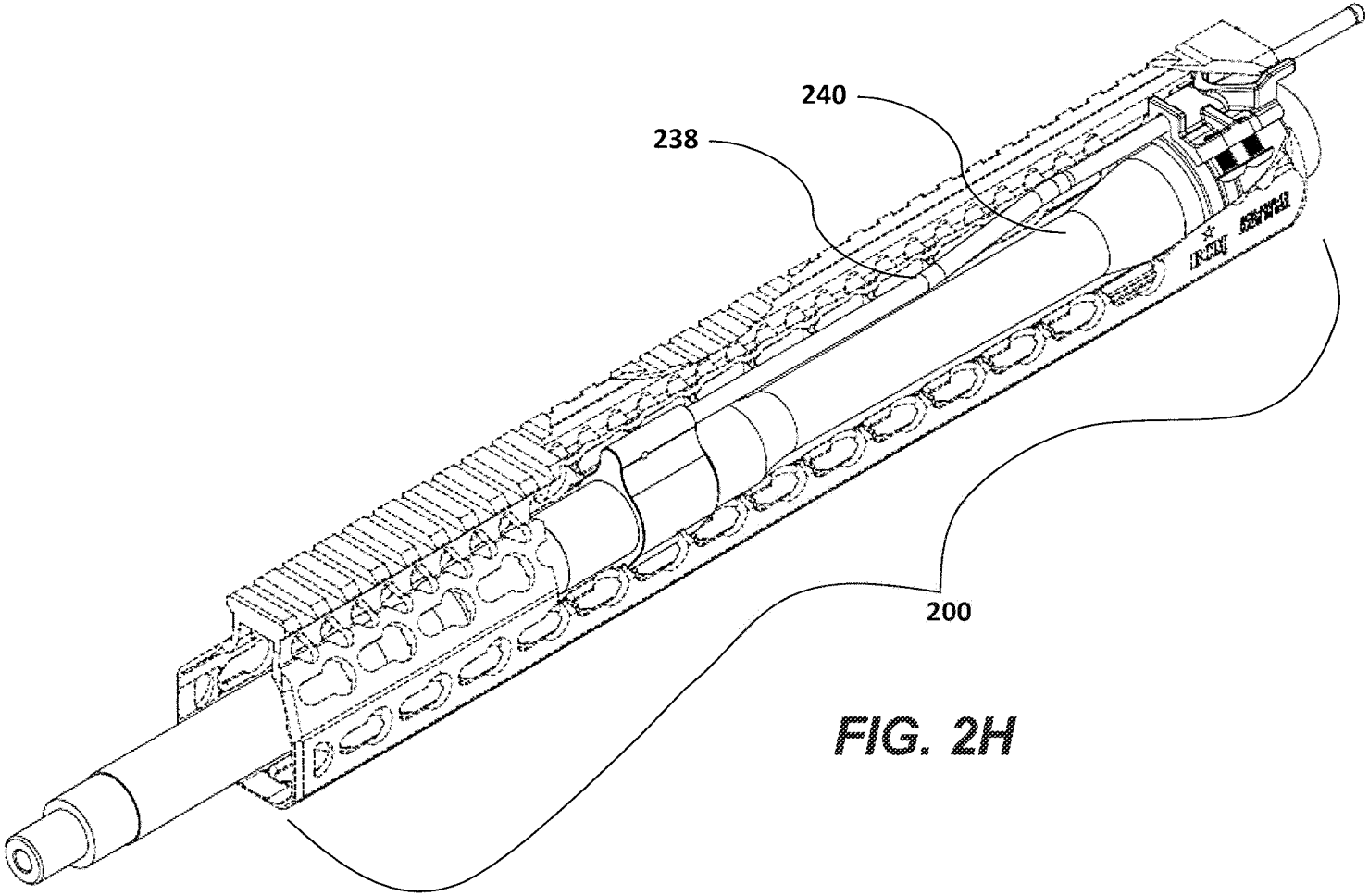
FIG. 2H illustrates a cross-sectional view of a of a fully assembled exemplary handguard assembly system according to a second embodiment.
Figure 2I:
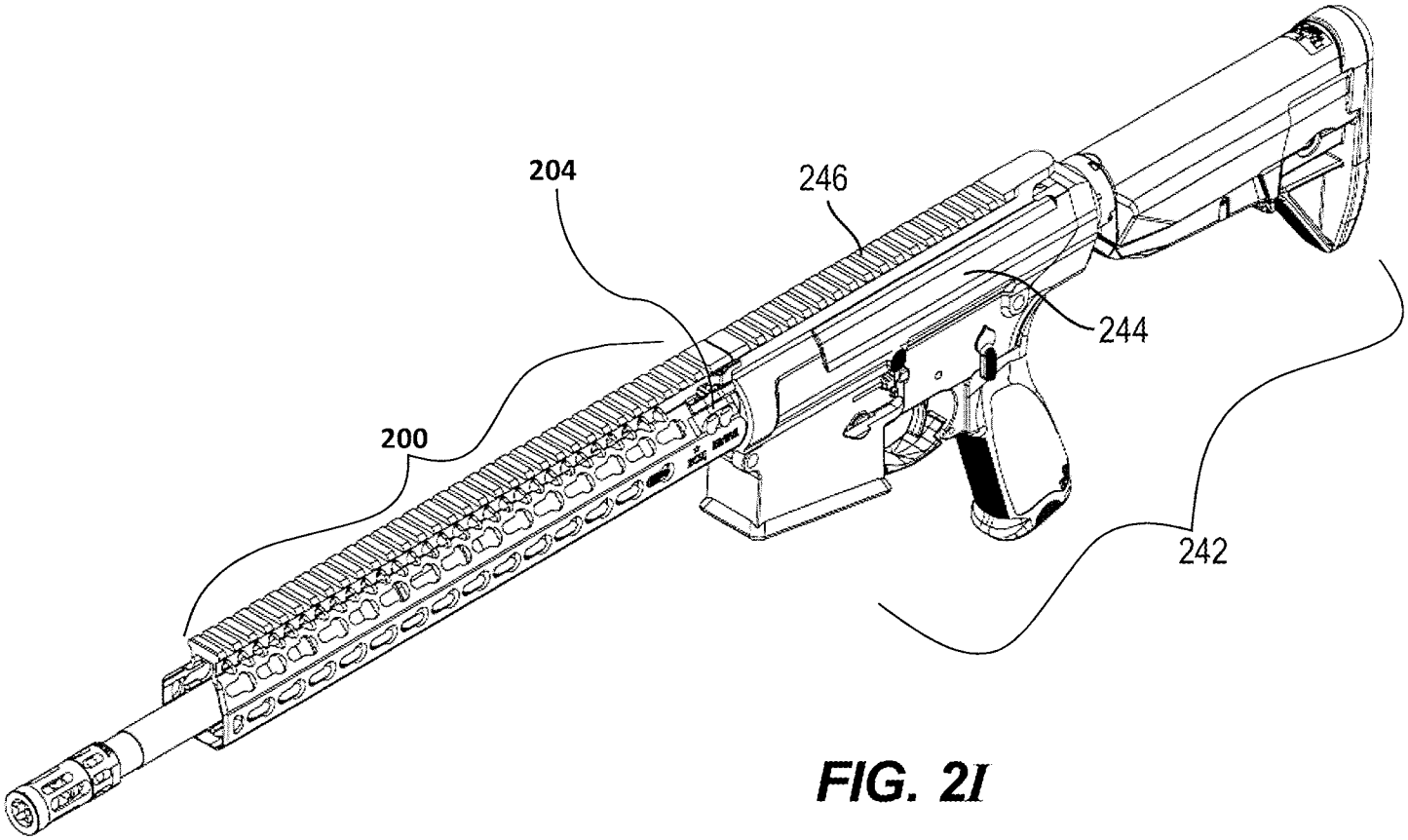
FIG. 2I illustrates a fully assembled firearm handguard assembly system on an exemplary firearm according to a second embodiment.

Referring now to FIG. 2G, illustrating a fully assembled firearm handguard assembly system according to the second embodiment, the barrel nut 202 is secured inside handguard 200 with screws 222, 224, 226, and 228, and with index block 204 in place, allowing handguard 200 to be fully indexed to the upper receiver of the firearm (see FIG. 2I). The design of the firearm handguard assembly strengthens the grip of the handguard on the barrel nut, by eliminating non-continuous features within the clamping area of the handguard body, keeping the handguard tensioned in place even under high stress and heat when the firearm is in use.

Referring now to FIG. 2H, illustrating a cross-sectional view of a fully assembled exemplary handguard assembly system according to the second embodiment, the handguard 200 includes gas tube 238 and barrel 240.

Referring now to FIG. 2I, illustrating a fully assembled firearm handguard on an exemplary firearm 242 according to the second embodiment. The firearm 242 is the same as the firearm 142 described above and includes an upper receiver 244 with a receiver rail 246. The same description of these features above applies to firearm 242. The handguard 200 is secured to exemplary firearm 242 at its upper receiver 244 with index block 204 and screws 222, 224, 226, and 228 in place.

An exemplary firearm may be an AR-10, AR-15, or a variant thereof. The present invention may also be used with any firearm that uses a threaded portion of the forward area of the upper receiver and/or action over which may pass any portion of the operating assembly. By way of example, and not limitation, these firearms may include bolt action rifles for which the user may desire a handguard or fore-end with a top rail and superior clamping force to the receiver. Exemplary embodiments are illustrated herein. The first embodiment, illustrated by FIGS. 1A-1I, shows the present invention on an AR-15 platform. The second embodiment, illustrated by FIGS. 2A-2B, shows the present invention on the AR-10 platform.

Although the exemplary embodiments described herein contain a block and screw assembly that requires one block and four screws, it is contemplated that more or less than four screws may be used. It is also contemplated that the block may be integrated into the handguard body.

The barrel nuts shown in FIGS. 1A-1I and FIGS. 2A-2I use a radial groove long and deep enough to pass a multitude of screws. Alternative embodiments of the barrel nut include, but are not limited to, a barrel nut design containing a plurality of apertures to allow the screws to pass through the apertures and engage the index block; a barrel nut design with a plurality of flat cuts that create clearance for the screws to pass; a barrel nut design with no forward flange but with a protrusion to support the screws; a barrel nut design without any forward flange, no clearance cuts, and which may have screws passing only in front of, or in front of and behind, the barrel nut in order to engage the apertures on either side of the handguard. The barrel nut and related metal mounting hardware made from any suitable structural material may be used in connection with the present invention, including without limitation steel (carbon and stainless) and titanium.

Figure 3A:
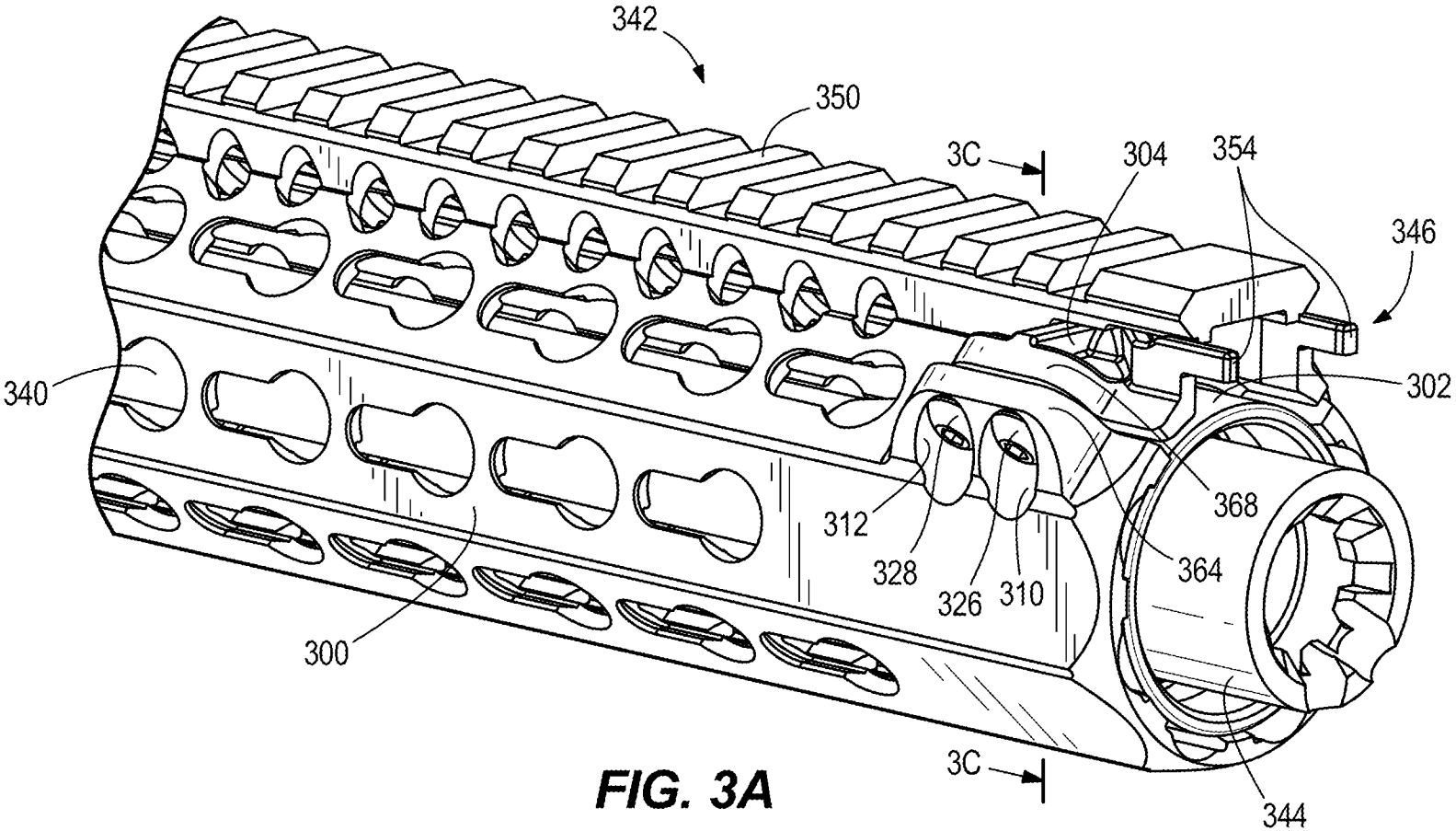
FIG. 3A is a perspective end view of a handguard assembly system according to a third embodiment.
Figure 3B:
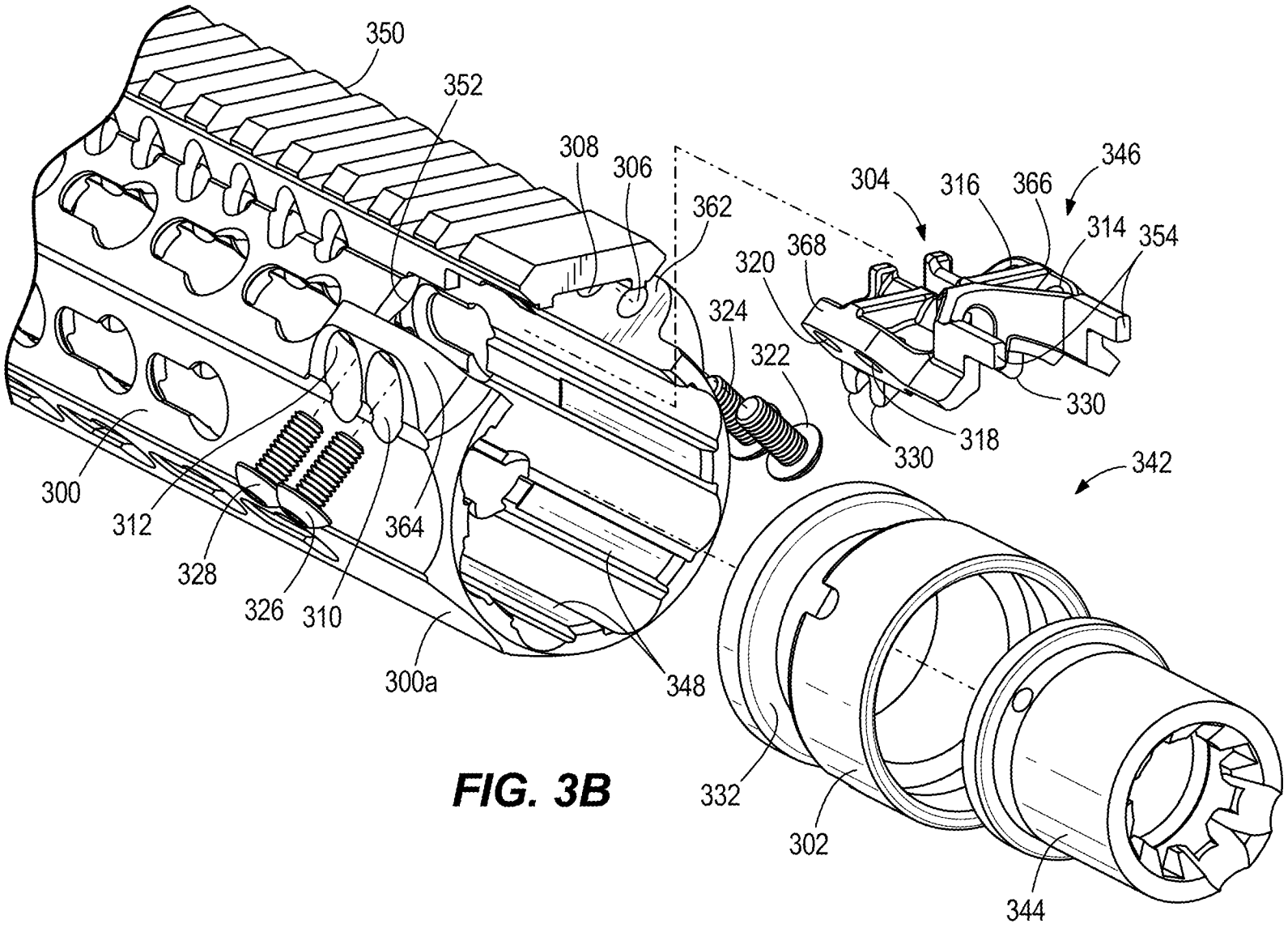
FIG. 3B is an exploded view of the system of FIG. 3A.
Figure 3C:
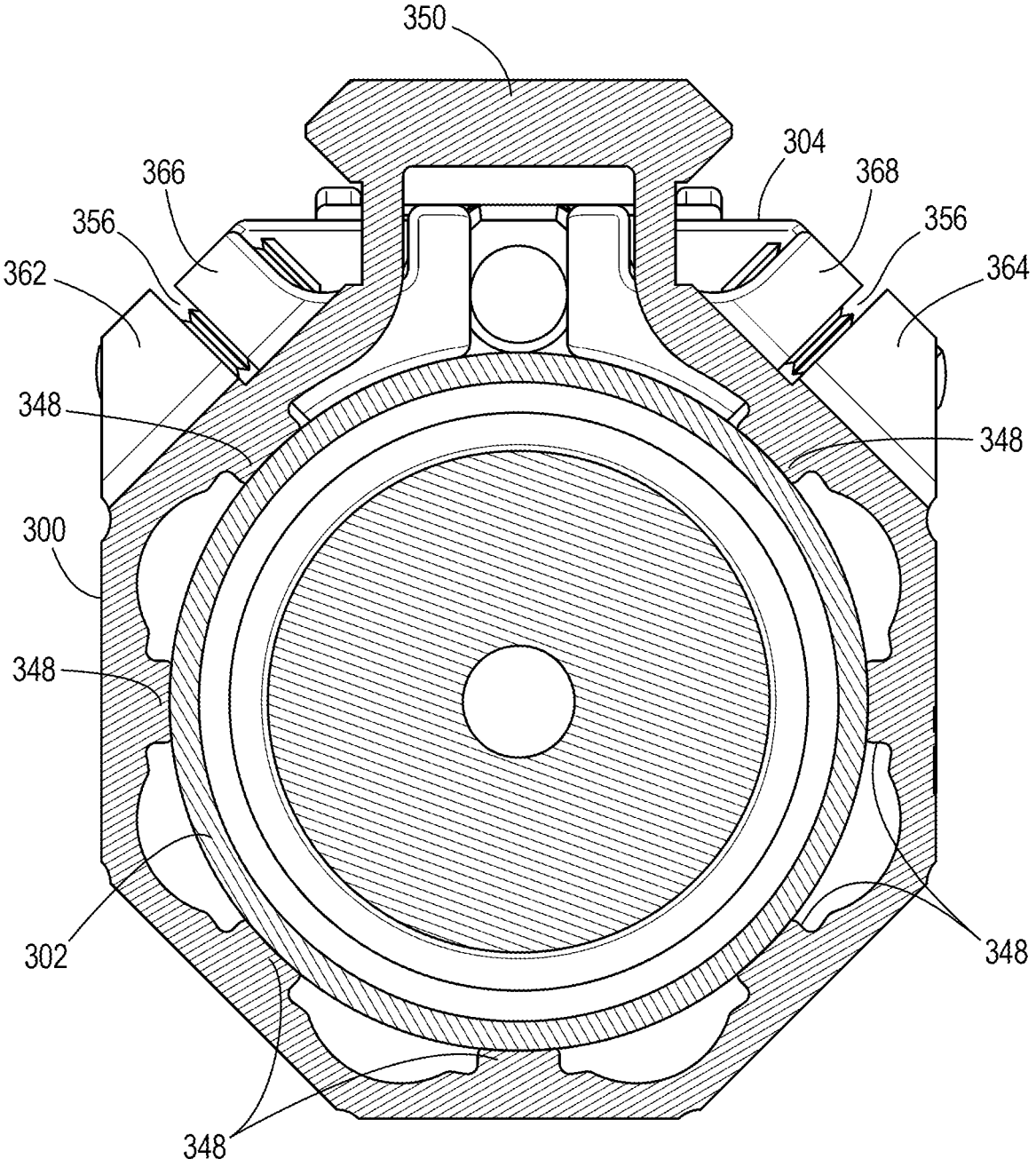
FIG. 3C is a cross-section view taken along line 3C-3C in FIG. 3A.

FIGS. 3A-3C illustrate a third embodiment of a firearm handguard assembly system 346 according to the present invention. The third embodiment of the firearm handguard assembly system 346 is for use with a firearm 342 similar or identical to the firearms 142, 242 described above. The firearm 342 includes an upper receiver having a receiver rail similar or identical to the upper receivers 144, 244 and receiver rails 146, 246 described above. The firearm 342 also includes a barrel nut 302 and a barrel 340 which are identical to the corresponding parts described above with respect to the firearms 142, 242. The barrel nut 302, for example, has a circumferential groove 332 in its outer surface. The illustrated barrel 340 includes a barrel extension 344 which includes locking lugs for the firearm's bolt. The barrel nut 302 securely mounts the barrel 340 to the upper receiver of the firearm 342.

The handguard assembly system 346 includes a handguard 300 and an index block 304. The handguard 300 includes internal ribs 348 that provide discrete clamping surfaces for clamping against the outer surface of the barrel nut 302 at discrete clamping locations around the circumference of the barrel nut 302. This is different from the substantially continuous clamping surfaces provided by the internal surfaces of the handguards 100, 200 described above. The internal ribs 348 can be provided with less material than is required to provide the substantially continuous clamping surface of the handguards 100, 200 described above. The handguard 300 consequently may be lighter than handguards 100, 200.

All handguard embodiments 100, 200, 300 of the present invention provide a clamping area around the outer surface of the barrel nut 102, 202, 302 for a radially-directed circumferentially-applied clamping force from the handguard 100, 200, 300 onto the barrel nut 102, 202, 302, but whereas the clamping area of the first two embodiments 100, 200 is continuous, the clamping area of the third embodiment 300 is the cumulative clamping area of the discrete clamping surfaces provided by the ribs 348.

Other than the ribs 348 in place of a substantially continuous clamping surface, the handguard 300 is identical or substantially similar to the handguards 100, 200 described above. For example, the handguard 300 includes a Picatinny rail 350 or other accessory mounting rail which aligns with a receiver rail on the upper receiver when the handguard is properly mounted to the upper receiver. A first end **300*a* of the handguard 300 includes a slot 352 between the Picatinny rail 350 and the tops of the right and left sides of the handguard 300. The tops of the right and left sides of the handguard 300 define respective first and second mounting flanges 362, 364. The first end 300*a* includes first and second smooth apertures (i.e., through bores) 306, 308 through the first mounting flange 362, and third and fourth smooth apertures (i.e., through bores) 310, 312 through the second mounting flange 364**.

The index block 304 is identical or substantially similar to the index blocks 104, 204 described above. The index block 304 includes first and second securing portions 366, 368 on the respective right and left sides of the index block 304. The securing portions 366, 368 are the sides or wings of the index block 304. The index block 304 further includes first and second threaded apertures 314, 316 in the first securing portion 366, and third and fourth threaded apertures 318, 320 in the second securing portion 368.

The index block 304 also includes a plurality of feet 330 for engaging the barrel nut 302 and a pair of indexing horns 354 to engage an upper receiver indexing feature (e.g., the receiver rail, other accessory mounting rail, or any other feature of the upper receiver). The feet 330 and indexing horns 354 are integrally formed (e.g., molded or cast) with the rest of the index block 304 such that the index block is a single-piece index block 304. It will be understood that the feet 330 and indexing horns 354 could alternatively be any suitable features for engaging the barrel nut 302 and an indexing feature of the upper receiver, as will be explained in more detail below.

The process for installing the handguard assembly system 346 on the firearm 342 is identical to the process described above, but will be briefly described again here. To install the handguard assembly system 346 on the firearm 342, the index block 304 is positioned on the barrel nut 302 with the feet 330 in the groove 332. The index block 304 and barrel nut 302 are then inserted into the first end **300*a* of the handguard 300 to insert the first and second securing portions 366, 368 in the slot 352. The barrel nut 302 and index block 304 are positioned in the first end 300*a* to align the first, second, third, and fourth threaded apertures 314, 316, 318, 320 of the index block 304 with the respective first, second, third, and fourth smooth apertures 306, 308, 310, 312 of the handguard 300. When initially installed, there is a gap 356 (FIG. 3C) between the first and second securing portions 366, 368 of the index block 304 and the respective first and second mounting flanges 362, 364 of the first end 300*a* of the handguard 300**.

First, second, third, and fourth screws 322, 324, 326, 328 are extended through the respective first, second, third, and fourth smooth apertures 306, 308, 310, 312 and threaded into the respective first, second, third, and fourth threaded apertures 314, 316, 318, 320. As the screws 322, 324, 326, 328 are tightened, the heads of the screws 322, 324, 326, 328 bear against the outside surface of the mounting flanges 362, 364, thereby narrowing the gaps 356. As the gaps 356 narrow, the top left and right sides of the first end 300*a* of the handguard 300 are drawn toward each. This results in a clamping action which is applied to the outer surface of the barrel nut 302 through the discrete clamping surfaces of the ribs 348.

Like the first two embodiments described above, the clamping action of the handguard assembly system 346 is continuous in the sense that there is circumferential tension through the whole left and right sides of the first end 300*a*. The left and right sides of the first end 300*a* of the handguard 300 act like a continuous band clamp or a strap. Unlike the two embodiments 100, 200 described above, however, the continuous clamping action of the handguard 300 is applied to the barrel nut 302 through the discrete clamping surfaces of the internal ribs 348. Thus, the continuous clamping action provides discrete, separate clamping forces spaced circumferentially around the outer surface of the barrel nut 302. The discrete, separate clamping forces of the handguard assembly system 346 generate sufficient friction to prevent rotation and axial (i.e., along the length of the barrel 340) movement of the handguard 300 with respect to the barrel nut 302.

As noted above, the feet 330 could alternatively be any suitable feature for engaging the barrel nut 302 such that the index block 304 is properly positioned on the barrel nut 302 for assembly into the handguard 300. The engagement of the feet 330 in the groove 332 provides additional resistance against axial movement of the index block 304 and handguard 300 with respect to the barrel nut 302.

Likewise, the indexing horns 354 could alternatively be replaced with any suitable configuration for engaging an indexing feature of the upper receiver 144, 244. in the illustrated embodiments, the indexing horns 354 engage opposite sides of the receiver rail 146, 246 so that the handguard 100, 200, or 300 is properly clocked or indexed to the upper receiver 144, 244 (e.g., so that the handguard rail 350 aligns with the receiver rail 146, 246) during installation. In other embodiments, the indexing horns 354 could be replaced with any suitable indexing extension that engages an indexing feature of the upper receiver 144, 244. For example, the indexing feature could be a single extension or finger on the index block 304 that engages a hole or groove in the upper receiver 144, 244. In addition to indexing the handguard 100, 200, or 300 to the upper receiver 144, 244, the indexing horns 354 provide some resistance to rotational movement of the handguard 300 with respect to the barrel nut 302.

The above description is illustrative and not restrictive. Many variations of the invention will become apparent to those of skill in the art upon review of this disclosure. While the present invention has been described in connection with a variety of embodiments, these descriptions are not intended to limit the scope of the invention to the particular forms set forth herein. To the contrary, the present descriptions are intended to cover alternatives, modifications, and equivalents as may be included within the spirit and scope of the invention as defined by the appended claim and otherwise appreciated by one of ordinary skill in the art.

What is claimed is:

1. A handguard assembly for installation on a firearm, the assembly comprising:

a handguard including first and second clearance apertures;

an index block having a first and second threaded apertures;

a first fastener extending through the first clearance aperture and threaded into the first threaded aperture to tighten the first fastener with respect to the index block, the first fastener defining a first longitudinal axis; and a second fastener extending through the second clearance aperture and threaded into the second threaded aperture to tighten the second fastener with respect to the index block, the second fastener defining a second longitudinal axis that is non-parallel and non-collinear with the first longitudinal axis;

wherein tightening the first and second fasteners with respect to the index block secures the handguard to the index block and prevents movement of the handguard relative firearm.

2. The handguard assembly of claim 1, wherein the second longitudinal axis is coplanar with the first longitudinal axis.

3. The handguard assembly of claim 1, wherein an angle between the first longitudinal axis and the second longitudinal axis is approximately 90 degrees.

4. The handguard assembly of claim 1, wherein the first and second threaded apertures are blind bores in the index block.

5. The handguard assembly of claim 1, wherein the firearm includes a gas tube and the index block extends at least partially over the gas tube.

6. The handguard assembly of claim 1, wherein the firearm includes a barrel nut defining an outer surface having a groove, a portion of the index block extending into the groove to resist movement of the handguard assembly in at least one direction with respect to the firearm.

7. The handguard assembly of claim 1, wherein the firearm includes a barrel nut defining an outer circular surface and the first and second longitudinal axes are parallel to respective first and second tangents to the circular surface.

8. The handguard assembly of claim 7, wherein the first and second fasteners are both above a horizontal plane bisecting the barrel nut.

9. The handguard assembly of claim 1, wherein the first and second fasteners are positioned symmetrically about a vertical plane.

* * * * *